US010954739B2

(12) United States Patent
Sehsah et al.

(10) Patent No.: US 10,954,739 B2
(45) Date of Patent: Mar. 23, 2021

(54) SMART ROTATING CONTROL DEVICE APPARATUS AND SYSTEM

(71) Applicant: Saudi Arabian Oil Company, Dhahran (SA)

(72) Inventors: Ossama R. Sehsah, Al Khobar (SA); Muhammad Muqeem, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 117 days.

(21) Appl. No.: 16/194,864

(22) Filed: Nov. 19, 2018

(65) Prior Publication Data

US 2020/0157910 A1 May 21, 2020

(51) Int. Cl.

| | |
|---|---|
| ***E21B 33/08*** | (2006.01) |
| ***E21B 47/00*** | (2012.01) |
| ***E21B 47/06*** | (2012.01) |
| ***E21B 41/00*** | (2006.01) |

(52) U.S. Cl.

CPC ..... *E21B 33/085* (2013.01); *E21B 41/0092* (2013.01); *E21B 47/00* (2013.01); *E21B 47/06* (2013.01)

(58) Field of Classification Search

CPC ..... E21B 33/085

See application file for complete search history.

(56) References Cited

U.S. PATENT DOCUMENTS

| | | | |
|---|---|---|---|
| 4,553,428 | A | 11/1985 | Upchurch |
| 4,688,642 | A | 8/1987 | Baker |
| 4,768,373 | A | 9/1988 | Spencer |
| 5,020,597 | A | 6/1991 | Braddick et al. |
| 5,181,570 | A | 1/1993 | Allwin et al. |
| 5,279,369 | A | 1/1994 | Brammer |
| 5,435,392 | A | 7/1995 | Kennedy |
| 5,740,863 | A | 4/1998 | Ortloff et al. |
| 5,743,333 | A | 4/1998 | Willauer et al. |
| 5,900,709 | A | 5/1999 | Kanda et al. |
| 5,975,204 | A | 11/1999 | Tubel et al. |
| 6,425,444 | B1 | 7/2002 | Metcalfe et al. |

(Continued)

FOREIGN PATENT DOCUMENTS

| | | |
|---|---|---|
| EP | 1898044 A2 | 3/2008 |
| EP | 2295712 A2 | 3/2011 |

(Continued)

OTHER PUBLICATIONS

International Search Report for PCT/IB2019/050168, 4 pages (dated Jul. 19, 2019).

(Continued)

*Primary Examiner* — Robert E Fuller

(74) *Attorney, Agent, or Firm* — Choate, Hall & Stewart, LLP; Charles E. Lyon; Jialan Zhang

(57) ABSTRACT

A rotating control device (RCD) includes a housing configured to make a connection above a wellbore and an assembly that mates to the housing. The assembly also includes a sealing element to make a seal to a drill string and to rotate with the drill string. One or more sensors are configured to monitor conditions during operation of the RCD. The one or more sensors include one or more erosion sensors to detect erosion of the sealing element. The one or more erosion sensors are also configured to identify amounts of erosion of the sealing element.

22 Claims, 4 Drawing Sheets

(56) References Cited

U.S. PATENT DOCUMENTS

| | | | |
|---|---|---|---|
| 6,499,537 | B1 | 12/2002 | Dewey et al. |
| 6,513,596 | B2 | 2/2003 | Wester |
| 6,540,024 | B2 | 4/2003 | Pallini et al. |
| 6,633,236 | B2 | 10/2003 | Vinegar et al. |
| 6,679,332 | B2 | 1/2004 | Vinegar et al. |
| 6,766,854 | B2 | 7/2004 | Ciglenec et al. |
| 6,789,621 | B2 | 9/2004 | Wetzel et al. |
| 6,817,410 | B2 | 11/2004 | Wetzel et al. |
| 6,834,725 | B2 | 12/2004 | Whanger et al. |
| 6,899,178 | B2 | 5/2005 | Tubel |
| 6,913,079 | B2 | 7/2005 | Tubel |
| 6,957,576 | B2 | 10/2005 | Skinner et al. |
| 7,015,411 | B2 | 3/2006 | Meister et al. |
| 7,104,324 | B2 | 9/2006 | Wetzel et al. |
| 7,114,561 | B2 | 10/2006 | Vinegar et al. |
| 7,116,099 | B2 | 10/2006 | Saito |
| 7,121,351 | B2 | 10/2006 | Luke et al. |
| 7,182,134 | B2 | 2/2007 | Wetzel et al. |
| 7,234,528 | B2 | 6/2007 | Pallini, Jr. et al. |
| 7,237,623 | B2 | 7/2007 | Hannegan |
| 7,274,989 | B2 | 9/2007 | Hopper |
| 7,286,453 | B2 | 10/2007 | Suzuki et al. |
| 7,316,274 | B2 | 1/2008 | Xu et al. |
| 7,389,685 | B2 | 6/2008 | Kosht et al. |
| 7,416,025 | B2 | 8/2008 | Bhat et al. |
| 7,487,837 | B2 | 2/2009 | Bailey et al. |
| 7,497,266 | B2 | 3/2009 | Fossli |
| 7,554,458 | B2 | 6/2009 | Hudson et al. |
| 7,658,228 | B2 | 2/2010 | Moksvold |
| 7,784,552 | B2 | 8/2010 | Brouse |
| 7,806,203 | B2 | 10/2010 | Krueger et al. |
| 7,836,946 | B2 | 11/2010 | Bailey et al. |
| 7,836,973 | B2 | 11/2010 | Belcher et al. |
| 7,845,404 | B2 | 12/2010 | McStay et al. |
| 7,861,789 | B2 | 1/2011 | Nelson |
| 7,870,898 | B2 | 1/2011 | Yeh et al. |
| 7,926,593 | B2 | 4/2011 | Bailey et al. |
| 8,066,059 | B2 | 11/2011 | Ferguson et al. |
| 8,091,631 | B2 | 1/2012 | Wetzel et al. |
| 8,113,291 | B2 | 2/2012 | Bailey et al. |
| 8,230,913 | B2 | 7/2012 | Hart et al. |
| 8,286,734 | B2 | 10/2012 | Hannegan et al. |
| 8,302,697 | B2 | 11/2012 | Kuo |
| 8,312,923 | B2 | 11/2012 | Patel et al. |
| 8,322,432 | B2 | 12/2012 | Bailey et al. |
| 8,400,326 | B2 | 3/2013 | Codazzi |
| 8,476,583 | B2 | 7/2013 | Legrand et al. |
| 8,522,867 | B2 | 9/2013 | Yeh et al. |
| 8,550,175 | B2 | 10/2013 | Shafiq et al. |
| RE45,011 | E | 7/2014 | Schetky et al. |
| 8,789,612 | B2 | 7/2014 | Haeberle et al. |
| 8,818,649 | B2 | 8/2014 | Udagawa |
| 8,881,843 | B2 | 11/2014 | Todd et al. |
| 9,022,113 | B2 | 5/2015 | Rex et al. |
| 9,074,443 | B2 | 7/2015 | Gray et al. |
| 9,243,381 | B2 | 1/2016 | Behmlander et al. |
| 9,274,243 | B2 | 3/2016 | Chau et al. |
| 9,322,248 | B2 | 4/2016 | Yeh et al. |
| 9,334,711 | B2 | 5/2016 | Hannegan et al. |
| 9,404,356 | B2 | 8/2016 | Benson et al. |
| 9,422,786 | B2 | 8/2016 | Yokley et al. |
| 2004/0124008 | A1 | 7/2004 | Fincher et al. |
| 2006/0017287 | A1 | 1/2006 | Milberger |
| 2006/0124354 | A1 | 6/2006 | Witte |
| 2007/0246263 | A1 | 10/2007 | Reitsma |
| 2008/0308274 | A1 | 12/2008 | MacDougall |
| 2009/0090499 | A1 | 4/2009 | Lewis et al. |
| 2011/0024195 | A1 | 2/2011 | Hoyer et al. |
| 2011/0114387 | A1 | 5/2011 | Belcher et al. |
| 2011/0155379 | A1 | 6/2011 | Bailey et al. |
| 2012/0186873 | A1 | 7/2012 | Shayegi et al. |
| 2014/0197766 | A1 | 7/2014 | Chabaud et al. |
| 2015/0024062 | A1 | 1/2015 | Pomytkin et al. |
| 2015/0240146 | A1 | 8/2015 | Sista et al. |
| 2015/0330200 | A1 | 11/2015 | Richard et al. |
| 2015/0337599 | A1* | 11/2015 | Bullock ..... E21B 3/00 175/24 |
| 2017/0096858 | A1 | 4/2017 | Watters et al. |
| 2018/0245444 | A1 | 8/2018 | Hardt et al. |
| 2020/0011751 | A1* | 1/2020 | Kazemi Miraki .... G01L 5/0042 |

FOREIGN PATENT DOCUMENTS

| | | | |
|---|---|---|---|
| WO | WO-2014/043396 | A2 | 3/2014 |
| WO | WO-2014/105077 | A2 | 7/2014 |
| WO | WO-2014/105305 | A1 | 7/2014 |
| WO | WO-2015/060836 | A1 | 4/2015 |
| WO | WO-2016/040346 | A1 | 3/2016 |
| WO | WO-2016/099456 | A1 | 6/2016 |

OTHER PUBLICATIONS

Written Opinion for PCT/IB2019/050168, 7 pages (dated Jul. 19, 2019).

* cited by examiner

SMART ROTATING CONTROL DEVICE APPARATUS AND SYSTEM

TECHNICAL FIELD

This specification relates generally to example rotating control devices (RCDs) having one or more sensors.

BACKGROUND

During construction of an oil or gas well, a drill string having a drill bit bores through earth, rock, and other materials to form a wellbore. The drilling process includes, among other things, circulating drilling fluid through the wellbore. This circulation includes pumping the drilling fluid from the surface into the wellbore and receiving the drilling fluid from the wellbore at the surface.

A rotating control device (RCD) is used during drilling to form a pressure seal to the drill string and thereby prevent hydrocarbons and drilling fluid from uncontrolled release from the wellbore. The drilling fluid, for example, may be diverted by the RCD to a reservoir. From there, the drilling fluid may be pumped back downhole to enable continued drilling.

SUMMARY

An example rotating control device (RCD) includes a housing configured to make a stationary connection above a wellbore and an assembly that mates to the housing. The assembly includes a borehole to contain part of a drill string. The assembly also includes a sealing element to make a seal to the drill string and to rotate with the drill string. One or more sensors are configured to monitor conditions during operation of the RCD. The one or more sensors include one or more erosion sensors to detect erosion of the sealing element. The one or more erosion sensors are also configured to identify amounts of erosion of the sealing element. The RCD may include one or more of the following features, either alone or in combination.

An erosion sensor among the one or more erosion sensors may include a first sensor to detect a first amount of erosion and a second sensor to detect a second amount of erosion. The second amount of erosion may be greater than the first amount of erosion. An erosion sensor among the one or more erosion sensors further may include a third sensor to detect a third amount of erosion. The third amount of erosion may be greater than the second amount of erosion. An erosion sensor among the one or more erosion sensors may include concentric rings integrated into the sealing element. Each ring may be for detecting a different amount of erosion of the sealing element.

The one or more sensors may be part of a rotation sensing system. The rotation sensing system may be for detecting a difference between rotation of the drill string and rotation of the sealing element. The rotation sensing system may include a first rotation sensor for detecting a rate of rotation of the drill string and a second rotation sensor for detecting a rate of rotation of the sealing element. The sealing element may include a first sealing element. The assembly may include a bearing for enabling the rotation of the first sealing element within the housing. The assembly may also include a second sealing element to make a seal to the drill string. The bearing may be between the first sealing element and the second sealing element. The first sealing element may be below the second sealing element. The one or more erosion sensors may include erosion sensors integrated into both the first sealing element and the second sealing element.

The RCD may include one or more pressure sensors to detect pressure at a location of the RCD. The assembly may also include a bearing for enabling the rotation within the housing. The one or more pressure sensors may be located on the bearing. The sealing element may be a first sealing element. The assembly may include a second sealing element to make a seal to the drill string. The bearing may be between the first sealing element and the second sealing element. The first sealing element may be below the second sealing element. The one or more pressure sensors may be for detecting failure of the first sealing element based on pressure detected by the one or more pressure sensors. The RCD may include a pressure gauge monitor located above the first sealing element. The pressure gauge monitor may be configured to provide information based on the pressure detected by the one or more pressure sensors.

The sealing element may include rubber. The one or more erosion sensors may include multiple erosion sensors that are embedded within the sealing element at different positions relative to an interior surface of the sealing element. An erosion sensor among the multiple erosion sensors may be triggered when wear in the sealing element impacts at least part of the erosion sensor.

The one or more sensors may include a rotation sensing system. The rotation sensing system may be for detecting a difference in rates of rotation between the drill string and the assembly.

An example system includes an RCD. The RCD includes a housing configured for stationary connection above a wellbore and an assembly connected to the housing. The assembly has a borehole to contain a part of a drill string. The assembly includes a sealing element to make a seal to the drill string and to rotate with the drill string. The RCD also includes sensors that are part of an erosion sensing system to detect erosion in the sealing element, and a rotation sensing system to detect a difference in a rate of rotation between the drill string and the sealing element. A control system is configured to receive information from the sensors and to control operation of the drill string based at least in part on the information. The system may include one or more of the following features, either alone or in combination.

The system also may include a wired network connection between the sensors and the control system. The information may pass over the wired network connection. The sensors may include wireless transmitters for transmitting the information to the control system wirelessly.

The erosion sensing system may include a first sensor to detect a first amount of erosion in the sealing element and a second sensor to detect a second amount of erosion in the sealing element. The second amount of erosion may be greater than the first amount of erosion. The erosion sensing system may also include a third sensor to detect a third amount of erosion in the sealing element. The third amount of erosion may be greater than the second amount of erosion. The erosion sensing system may include concentric rings integrated into the sealing element. Each concentric ring may include a sensor for detecting a different amount of erosion of the sealing element. The erosion sensing system may include multiple erosion sensors that are embedded at different positions within the sealing element relative to an interior surface of the sealing element. An erosion sensor among the multiple erosion sensors may be triggered when wear in the sealing element impacts at least part of the erosion sensor.

The rotation sensing system may include a first rotation sensor for detecting a rate of rotation of the drill string and a second rotation sensor for detecting a rate of rotation of the assembly.

Controlling operation of the drill string may include comparing the information to one or more predefined thresholds and discontinuing operation of the drill string automatically when at least some of the information exceeds a predefined threshold among the one or more predefined thresholds. Controlling operation of the drill string may include outputting the information for display, receiving user input following display of the information, and discontinuing operation of the drill string based on the user input.

Any two or more of the features described in this specification, including in this summary section, may be combined to form implementations not specifically described in this specification.

All or part of the systems and processes described in this specification may be controlled by executing, on one or more processing devices, instructions that are stored on one or more non-transitory machine-readable storage media. Examples of non-transitory machine-readable storage media include read-only memory, an optical disk drive, memory disk drive, random access memory, and the like. All or part of the systems and processes described in this specification may be controlled using a computing system comprised of one or more processing devices and memory storing instructions that are executable by the one or more processing devices to perform various control operations.

The details of one or more implementations are set forth in the accompanying drawings and the description subsequently. Other features and advantages will be apparent from the description and drawings, and from the claims.

DESCRIPTION OF THE DRAWINGS

Like reference numerals in different figures indicate like elements.

DETAILED DESCRIPTION

Described in this specification are example rotating control devices (RCDs) having one or more sensors. The sensors include environmental sensors.

Examples of environmental sensors include pressure sensors to detect pressure within the well and temperature sensors to detect temperature within the well. The sensors also include operational sensors. Examples of operational sensors include erosion sensors to detect erosion occurring on the RCD and rotation sensors to detect differences in rotation between RCD components and a drill string that passes through the RCD. The sensors output information that may be used to control drilling operations. For example, if the amount of wear on the RCD exceeds an acceptable amount, then drilling may be interrupted while all or part of the RCD is replaced. Similarly, if the rotation sensors detect differences in rates of rotation between the RCD components and the drill string, then then drilling may be interrupted to determine if repairs or other actions are required.

An example RCD includes a housing configured to make a stationary connection above a wellbore. For example, the RCD may be mounted above a blowout preventer (BOP) above a rig floor. A BOP includes a valve or other device that creates a seal to prevent uncontrolled escape of hydrocarbons and other liquids or gases from the well. In this example, the RCD housing connection is stationary in the sense that the housing does not move even in the presence of a rotating drill string. The RCD also includes an assembly that mates to the housing. For example, the assembly may include a bearing and sealing elements located above and below the bearing. The sealing elements may be made of a malleable material, such as rubber, to make a pressure seal between the assembly and the drill string. In some examples, the seal may be air tight, liquid tight, or both. The seal reduces the chances that wellbore fluids, such as hydrocarbons and drilling fluid, will escape uncontrollably from the well. The bearing and sealing elements rotate with the drill string during its operation. The RCD also includes environmental and operational sensors, as noted. The sensors are configured—for example, connected, arranged, or constructed—to monitor conditions during use of the RCD.

Figure 1:
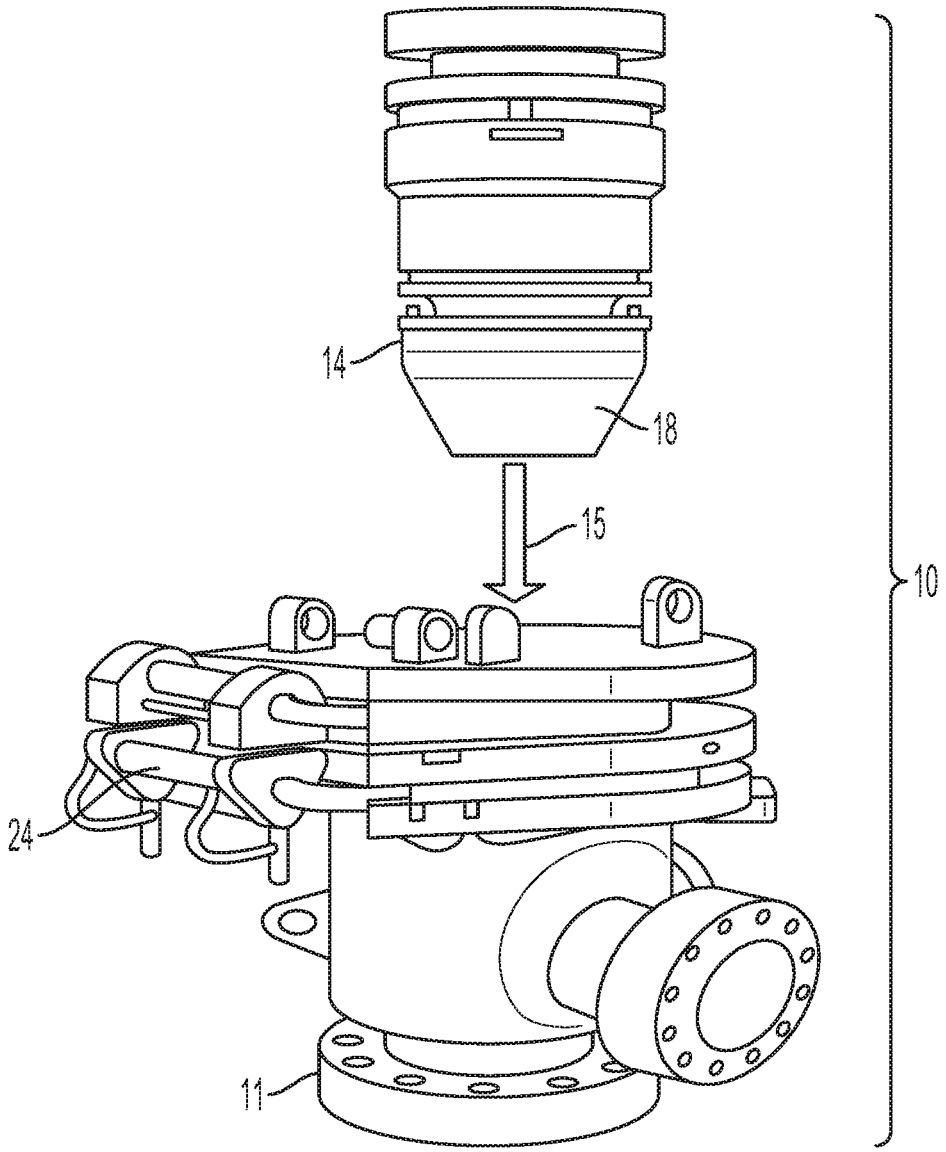
FIG. 1 is a perspective view of an example rotating control device (RCD).
Figure 2:
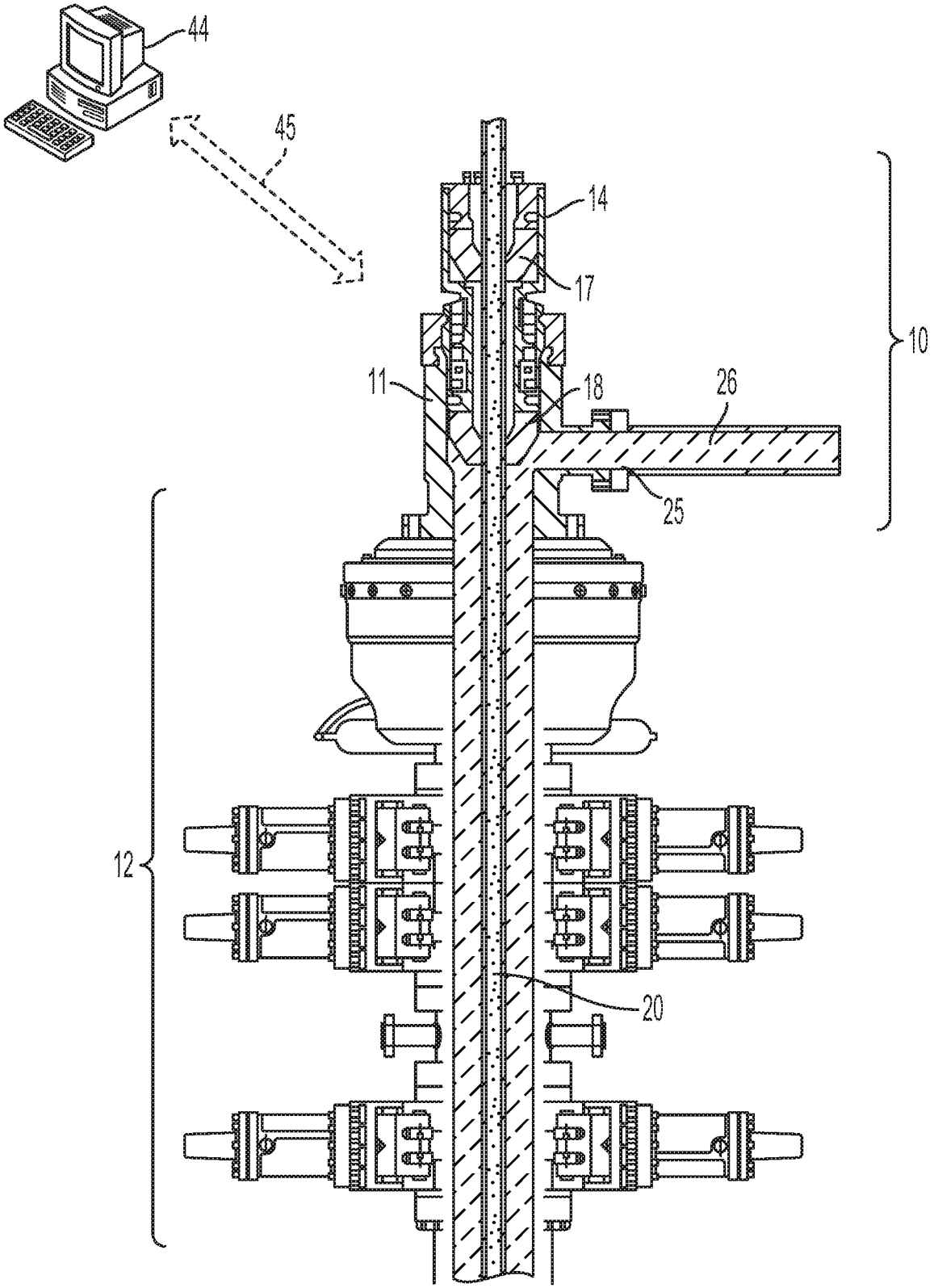
FIG. 2 is a cross-sectional view of the example RCD connected atop a blowout preventer (BOP) of a well.
Figure 3:
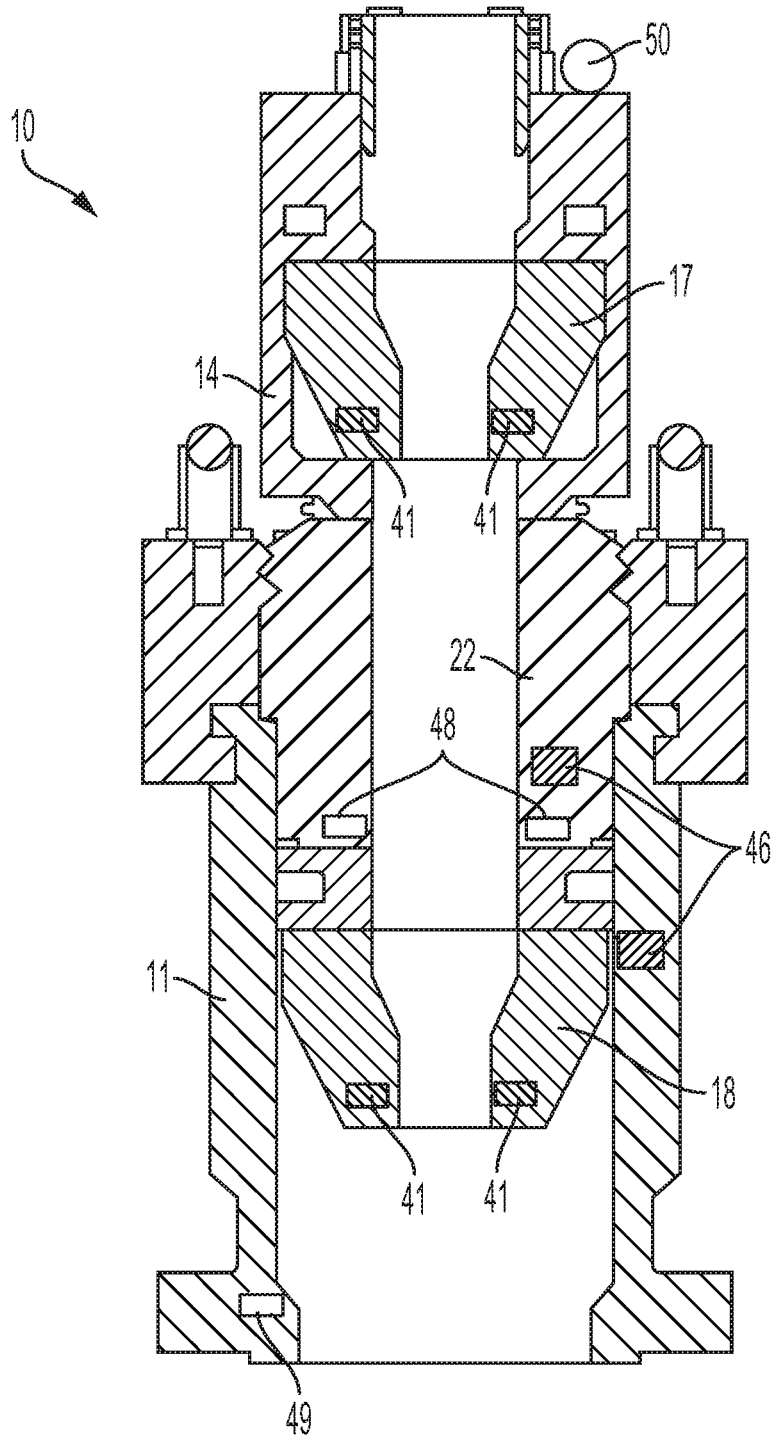
FIG. 3 is a close-up cross-sectional view of the example RCD.

FIGS. 1, 2, and 3 show an example RCD 10 having features of the type described in the preceding paragraphs. RCD 10 includes a housing 11 that is configured to make a stationary connection above a wellbore. For example, the RCD may be located at the wellhead above a BOP stack 12. RCD 10 includes an assembly 14 that fits within housing 11. In this example, assembly 14 moves along the direction of arrow 15 to mate to housing 11. The assembly includes sealing elements 17 and 18 that define part of a borehole. During drilling, a drill string, such as drill string 20 runs through the borehole and rotates within the borehole. The sealing elements each makes a pressure seal to both the drill string and to structure around the drill string such as the assembly. As noted, the seal may be air tight, liquid tight, or both to prevent uncontrolled release of drilling fluids at the wellhead.

The assembly also includes one or more bearings 22 in contact with the sealing elements. At least part of the bearings 22 is between an upper sealing element 17 and a lower sealing element 18. The lower sealing element is located closer to the BOP than the upper sealing element during operation of the RCD. The pressure seal between the sealing elements and the drill string couples the sealing elements to the drill string such that the two rotate can rotate together. The bearings, which are rotatable within the RCD housing, enable the sealing elements to rotate along with the drill string. That is, the sealing elements are connected to both the bearings and the drill string. So, rotation of the drill string is transferred to the bearings, which rotate in response. Ideally, as the drill string rotates, the sealing elements rotate at a same rate as the drill string. A difference between the rate of rotation of the drill string and the rate of rotation of the sealing elements can cause friction, which can lead to erosion in the sealing elements.

Housing 11 also includes a connection mechanism 24. Connection mechanism 24 is configured to connect housing 11 to assembly 14. For example, the connection mechanism may include one or more latches or clamps to implement the connection between the housing and the assembly. In an example, the assembly is lowered into the housing along the direction of arrow 15 and the connection mechanism is activated. Notably, connection between the housing and the assembly does not inhibit rotation of the bearings, the sealing element, or the drill string. The housing, however, is stationary. For example, as noted, the housing does not move or rotate in response to rotation of the drill string.

As shown in FIG. 2, RCD 10 is configured to divert content such as drilling fluid, hydrocarbons, gases, and wellbore cuttings to a reservoir (not shown). For example, the RCD may include a pipe 25 or valve to divert the content 26 from the wellbore. In the case of drilling fluid, the drilling fluid may be circulated from the reservoir back into the wellbore. For example, the drilling fluid may be pumped from the reservoir back downhole in order to enable continued drilling by the drill string.

As explained previously, in some implementations, RCD 10 includes one or more operational sensors, one or more environmental sensors, or both one or more operational sensor and one or more environmental sensors. Examples of operational sensors include erosion sensors and rotation sensors. For example, the erosion sensors may be part of an erosion sensing system to detect material loss, such as rubber loss, in the sealing elements and the extent of that material loss. In this regard, as the amount of material in the sealing elements decreases, the sealing elements are less effective at creating a seal to the drill string and, thus, less effective at preventing hydrocarbons and drilling fluid from uncontrolled release from a wellbore. For example, as the sealing elements wear, hydrocarbons and drilling fluid may leak through the sealing elements and out through the wellhead.

The sealing elements may exhibit erosion, such as material loss, due to a difference between the rate of rotation of the drill string and the rate of rotation of the sealing elements. That is, under ideal conditions, the drill string and the sealing elements rotate at the same rate. As a result, there is little or no friction between the two and, therefore, little or no erosion of the sealing elements occurs. However, when the drill string rotates at a different rate than the sealing elements, there is friction. This friction causes the sealing elements to erode, which can adversely affect the operation of the RCD as described. Accordingly, the rotation sensing system is used to detect a difference between the rate of rotation of the drill string and the rate of rotation in the sealing elements.

Figure 4:
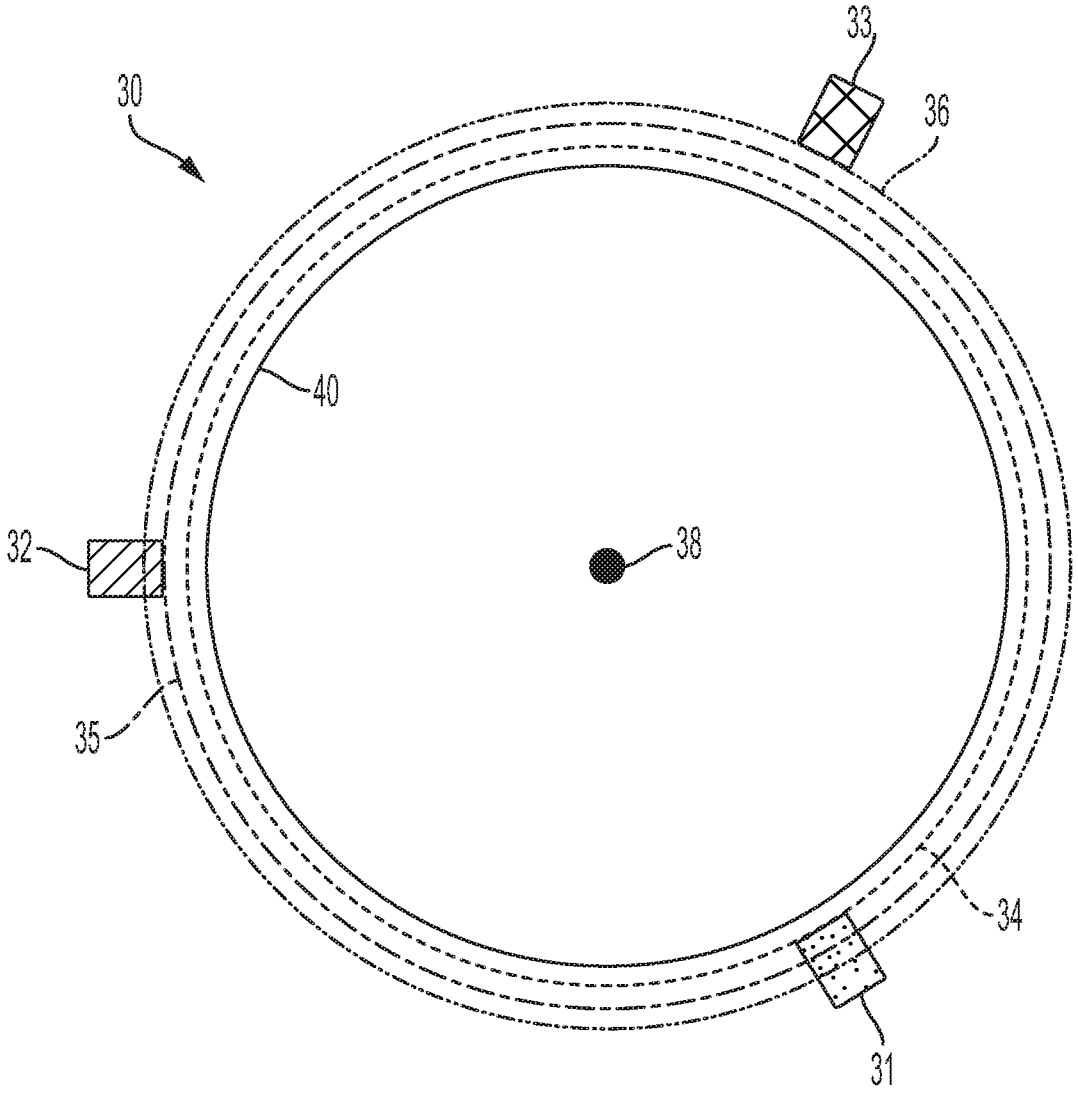
FIG. 4 is a cross-sectional top view of an example erosion sensor that may be used to detect erosion in the example RCD.

FIG. 4 shows components 30 of an example erosion sensing system that may be incorporated into the RCD. Components 30 include multiple erosion sensors. In the example of FIG. 4, there are three erosion sensors 31, 32, and 33. These erosion sensors include rings that are integrated into a sealing element 17, 18. In an example, each erosion sensor includes a sensing ring located at a different radius 34, 35, and 36, respectively, from a center 38 of the RCD and embedded within the material—for example, rubber—that makes up the sealing element. Radius 40 shows the inner boundary of the sealing element when no erosion has occurred. In this example, the sensing rings are concentric such that each sensor is at a different position within the sealing element relative to an interior surface 40 of the sealing element. In other implementations, one or more discrete erosion sensors may located at different radii from a center 37 of the RCD. For example, rather than sensing erosion at any point along different circumferences as in the configuration of FIG. 4, the erosion sensors may detect erosion at different discrete points.

In some implementations, different erosion sensors are located at different radii in order to detect different amounts of erosion. For example, in FIG. 4, first erosion sensor 31 is configured—for example, constructed, arranged, or both constructed and arranged—to detect a first amount of erosion. Second erosion 32 sensor is configured to detect a second amount of erosion that is greater than the first amount of erosion. Third erosion sensor 33 is configured to detect a third amount of erosion that is greater than the second amount of erosion. In this example, first erosion sensor 31 is configured to detect 1/16 inch (1.59 millimeters—mm) of erosion; second erosion sensor 32 is configured to detect 2/16 inch (3.18 mm) of erosion; and third erosion sensor 33 is configured to detect 3/16 inch (4.76 mm) of erosion. Although three erosion sensors are shown, any number of erosion sensors may be used, such as one, two, four, five, six, seven, or eight erosion sensors. In addition, the erosion sensors may detect different amounts of erosion than those amounts presented.

Referring to FIG. 3, one or more erosion sensors 41, which may be of the type shown in FIG. 4, may be incorporated into upper sealing element 17, into lower sealing element 18, or into both upper sealing element 17 and lower sealing element 18. The erosion sensors may be configured to communicate with a control system, which may be a component of the erosion sensing system.

The control system may be or include a computing system 44, as shown in FIG. 2. Communications between the sensors and the computing system are represented by arrow 45. For example, readings from the sensors may be sent to the computing system in real-time or the computing system may query the sensors for readings or other information. In this regard, real-time may include actions that occur on a continuous basis or track each other in time taking into account delays associated with processing, data transmission, and hardware.

The computing system may be configured—for example, programmed, connected, or both programmed and connected—to control operations, such as drilling, to form or to extend a well. For example, a drilling engineer may input commands to the computing system to control such operations. In response to these commands, the computing system may control hydraulics, electronics, or motors that control, for example, operation of the drill string or operation of one or more pumps to move drilling fluid into the wellbore. Examples of computing systems that may be used are described in this specification. Signals may be exchanged between the computing system, RCD sensors, and other wellbore components via wired or wireless connections. For example, there may be a wired or wireless network connection between the erosion sensors and the control system. For example, the signals may be sent over a wired data bus that is not part of a network or using radio frequency (RF) signals that are not part of a network. To implement wireless communication, each sensor may include a wireless transmitter or be connected to transmit data over a wireless transmitter. Each sensor may include a wireless receiver or be connected to receive data over a wireless receiver in order to receive information, such as queries, from the control system.

The control system may include on-board circuitry or an on-board computing system to implement control and monitoring functions. The on-board circuitry or on-board computing system is "on-board" in the sense that it is located on the RCD itself or on a component that is part of the well. The on-board circuitry or on-board computing system may communicate with computing system 44 to implement the control and monitoring functions. For example, commands input by a user into the computing system may be transferred for execution by the on-board computing system. Alternatively, the on-board circuitry or on-board computing system may be used instead of the computing system located at the surface. For example, the on-board circuitry or on-board computing system may be configured—for example programmed—to implement control instructions in a sequence that does not require user input. The on-board circuitry or on-board computing system may include solid state circuitry, programmable logic, or one or more microprocessors, for example. In an example operation, a sealing element in the RCD may erode during operation of the RCD. Erosion may occur, for example, during the normal course of the RCD's operation or as a result of a difference in rotation between the drill string and the sealing element. In any case, an erosion sensor on the RCD is triggered when wear in the sealing element impacts at least part of that erosion sensor. In the example of FIG. 4, erosion that impacts all or part of first sensor 31 triggers that first sensor to send a signal to the control system. In this example, impact includes erosion of the material comprising the erosion sensor to the point that a sensor or sensor ring is reached. As a result, the control system then knows that the sealing element associated with that sensor has 1/16 inch (1.59 mm) of erosion at the position of the sensor. In the example of FIG. 4, erosion that impacts all or part of second sensor 32 triggers that second sensor to send a signal to the control system. As a result, the control system then knows that the sealing element associated with that sensor has 2/16 inch (3.18 mm) of erosion at the position of the sensor. In the example of FIG. 4, erosion that impacts all or part of third sensor 33 triggers that third sensor to send a signal to the control system. As a result, the control system then knows that the sealing element associated with that sensor has 3/16 inch (4.76 mm) of erosion at the position of the sensor. The sensor signals may contain identifiers that are unique to each corresponding sensor. Using these identifiers, the control system may identify the sensor that sent a signal.

Each time an erosion signal is received, the control system may react based on its programming. For example, the control system may compare the amount of erosion to one or more predefined thresholds. If the amount of erosion exceeds the one or more predefined thresholds, the control system may discontinue operation of the drill string automatically—for example, absent user intervention. In some implementations, the control system may display the amount of erosion on a monitor or other display device and wait for input from a user before taking action. For example, in response to user input, the control system may discontinue drilling activities or instruct replacement of the sealing element or the entire RCD. In some implementations, lesser amounts of erosion, such as 1/16 inch (1.59 mm), may be tolerable and require no action, whereas greater amounts of erosion, such as 3/16 inch (4.76 mm), may necessitate replacement of all or part of the RCD.

As noted, the RCD may also include a rotation sensing system for detecting a difference between rates of rotation of the drill string and rates of rotation of the sealing elements. Referring to FIG. 3, the rotation sensing system may include rotation sensors 46 to detect the rates of rotation of the drill string and the sealing elements. The rotation sensors may detect the rate of rotation in units of rotations-per-minute. The rotation sensors that detect rates of rotation of the drill string may include one or more rotation sensors on the drill string itself. The rotation sensors that detect rates of rotation of the sealing elements may include one or more of the following: one or more rotations sensors located on the RCD bearing 22 or associated structure, one or more rotation sensors located on upper sealing element 17, one or more rotation sensors located on upper sealing element 18, or one or more rotation sensors on the housing 11 to detect rotation in a bearing contained within the housing. In the example of FIG. 4 the drill string is not shown; however, rotation sensors 46 on bearings 22 and housing 11 are shown.

The rotation sensors may be configured to communicate with the control system, which may be considered part of the rotation sensing system. For example, rotation sensors on the drill string and the bearing assembly may send to the control system the rates of rotation of the drill string and of the bearing. Since the sealing elements are connected to the bearing, once the rate of rotation of the bearing is known, the rate of rotation of the sealing elements is also known. The control system may determine if there are any differences between the rates of rotation of the drill string and of the sealing elements. If the rates are different, then that may be an indication that the sealing elements are worn, for example, that they have eroded. Likewise, if the rates are different, that may be an indication that there are other problems with the RCD or that the sealing elements are in danger of erosion. If the rates of rotation are significantly different, the control system may cease drilling activities or instruct replacement of a sealing element or the entire RCD. In some examples, the rates of rotation are significantly different if the two rates differ by more than 1%, 2%, 3%, 4%, 5%, 10%, 15%, 20%, 25%, or 50%.

As noted, the RCD may include environmental sensors, such as pressure sensors to sense pressure within the well and temperature sensors to sense temperature within the well. Signals from these temperature and pressure sensors may be sent to the control system wirelessly or over wired connections.

In an example, the RCD may include one or more pressure sensors to detect pressure at a location within or near the RCD. In the example, of FIG. 4, two pressure sensors 48 are located on bearing 22 that rotates within the RCD housing. The bearing, and thus the pressure sensors, are located between the upper sealing element 17 and the lower sealing element 18. Accordingly, pressure sensors 48 are configured to detect the pressure that is between the two sealing elements. If this pressure is within a prescribed range, then the control system infers that the lower sealing element is operating acceptably. However, if the pressure detected by pressure sensors is equivalent to, or within a range of, the pressure downhole (which may be detected by other pressure sensors that are not shown), then the control system infers that the lower sealing element has failed, at least in part. In response, the control system may discontinue drilling activities or instruct replacement of the sealing element or the entire RCD.

One or more temperature sensors 49 may be located within the RCD. For example, the temperature sensors may detect the temperature at the uppermost part of the wellbore, between the two sealing elements, or elsewhere on the RCD.

In some implementations, the control system may display the temperature, the pressure, or both the temperature and pressure on a monitor or other display device and wait for input from a user before taking any action. In some implementations, RCD 10 may include a pressure gauge monitor 50 located above the first sealing element. The pressure gauge monitor may receive signals from the pressure sensors or from the control system and provide, on the RCD itself, information based on the pressure detected by the one or more pressure sensors.

All or part of the system and processes described in this specification and their various modifications may be controlled at least in part, by one or more computers using one or more computer programs tangibly embodied in one or more information carriers, such as in one or more non-transitory machine-readable storage media. A computer program can be written in any form of programming language, including compiled or interpreted languages, and it can be deployed in any form, including as a stand-alone program or as a module, part, subroutine, or other unit suitable for use in a computing environment. A computer program can be deployed to be executed on one computer or on multiple computers at one site or distributed across multiple sites and interconnected by a network.

Actions associated with controlling the system and processes can be performed by one or more programmable processors executing one or more computer programs to control all or some of the well formation operations described previously. All or part of the system and processes can be controlled by special purpose logic circuitry, such as, an FPGA (field programmable gate array), an ASIC (application-specific integrated circuit), or both an FPGA and an ASIC.

Processors suitable for the execution of a computer program include, by way of example, both general and special purpose microprocessors, and any one or more processors of any kind of digital computer. Generally, a processor will receive instructions and data from a read-only storage area or a random access storage area or both. Elements of a computer include one or more processors for executing instructions and one or more storage area devices for storing instructions and data. Generally, a computer will also include, or be operatively coupled to receive data from, or transfer data to, or both, one or more machine-readable storage media, such as mass storage devices for storing data, such as magnetic, magneto-optical disks, or optical disks. Non-transitory machine-readable storage media suitable for embodying computer program instructions and data include all forms of non-volatile storage area, including by way of example, semiconductor storage area devices, such as EPROM (erasable programmable read-only memory), EEPROM (electrically erasable programmable read-only memory), and flash storage area devices; magnetic disks, such as internal hard disks or removable disks; magneto-optical disks; and CD-ROM (compact disc read-only memory) and DVD-ROM (digital versatile disc read-only memory).

Elements of different implementations described may be combined to form other implementations not specifically set forth previously. Elements may be left out of the system and process described without adversely affecting their operation or the operation of the system in general. Furthermore, various separate elements may be combined into one or more individual elements to perform the functions described in this specification.

Other implementations not specifically described in this specification are also within the scope of the following claims.

What is claimed is:

1. A rotating control device (RCD) comprising:

a housing configured to make a connection above a wellbore;

an assembly that mates to the housing, the assembly comprising a sealing element to seal to a drill string and to rotate with the drill string; and one or more sensors to monitor conditions during operation of the RCD, the one or more sensors comprising one or more erosion sensors to detect erosion of the sealing element, the one or more erosion sensors being configured to identify amounts of erosion of the sealing element, where each of the one or more erosion sensors comprises concentric rings integrated into the sealing element, each of the concentric rings detecting a different amount of erosion of the sealing element, and each of the concentric rings is located at a different radius.

2. The RCD of claim 1, where an erosion sensor among the one or more erosion sensors comprises:

a first concentric ring to detect a first amount of erosion; and a second concentric ring to detect a second amount of erosion, the second amount of erosion being different from the first amount of erosion.

3. The RCD of claim 2, where an erosion sensor among the one or more erosion sensors further comprises:

a third concentric ring to detect a third amount of erosion, the third amount of erosion being greater than the second amount of erosion.

4. The RCD of claim 1, where the one or more sensors are part of a rotation sensing system, the rotation sensing system for detecting a difference between rates of rotation of the drill string and rotation of the sealing element.

5. The RCD of claim 4, where the rotation sensing system comprises a first rotation sensor for detecting a rate of rotation of the drill string and a second rotation sensor for detecting a rate of rotation of the sealing element.

6. The RCD of claim 1, where the sealing element is a first sealing element; and where the assembly further comprises:

a bearing for enabling rotation of the drill string within the housing, where the housing is stationary relative to the rotation; and a second sealing element to seal to the drill string, the bearing being between the first sealing element and the second sealing element, the first sealing element being below the second sealing element.

7. The RCD of claim 6, where the one or more erosion sensors comprise erosion sensors integrated into both the first sealing element and the second sealing element.

8. The RCD of claim 1, further comprising:

one or more pressure sensors to detect pressure at a location of the RCD.

9. The RCD of claim 8, where the assembly further comprises:

a bearing for enabling rotation of the drill string within the housing, the one or more pressure sensors being located on the bearing, where the housing is stationary relative to a rotation of the drill string.

10. The RCD of claim 9, where the sealing element is a first sealing element;

where the assembly further comprises a second sealing element to seal to the drill string, the bearing being between the first sealing element and the second sealing element, the first sealing element being below the second sealing element; and where the one or more pressure sensors are for detecting failure of the first sealing element based on pressure detected by the one or more pressure sensors.

11. The RCD of claim 10, further comprising:

a pressure gauge monitor located above the first sealing element, the pressure gauge monitor for providing information based on the pressure detected by the one or more pressure sensors.

12. The RCD of claim 1, where the sealing element comprises rubber;

where the one or more erosion sensors comprise multiple erosion sensors that are embedded within the sealing element at different positions relative to an interior surface of the sealing element, an erosion sensor among the multiple erosion sensors being triggered when wear in the sealing element impacts at least part of the erosion sensor; and where the one or more sensors are part of a rotation sensing system, the rotation sensing system for detecting a difference in rates of rotation between the drill string and the assembly.

13. A system comprising:

a rotating control device (RCD) comprising:

a housing configured to make a connection above a wellbore;

an assembly connected to the housing, the assembly comprising a sealing element to seal to a drill string and to rotate with the drill string;

sensors comprising:

an erosion sensing system to detect erosion in the sealing element; and a rotation sensing system to detect a difference in a rate of rotation between the drill string and the sealing element; and a control system to receive information from the sensors and to control operation of the drill string based at least in part on the information, where the erosion sensing system comprises one or more erosion sensors, where the one or more erosion sensors comprise concentric rings integrated into the sealing element, and where each of the concentric rings is located at a different radius.

14. The system of claim 13, further comprising:

a wired network connection between the sensors and the control system, the information passing over the wired network connection, the wired network connection being or comprising a wired data bus.

15. The system of claim 13, where the sensors comprise wireless transmitters for transmitting the information to the control system using a wireless connection, the wireless connection comprising radio frequency signals.

16. The system of claim 13, where the one or more erosion sensors comprise:

a first sensor to detect a first amount of erosion in the sealing element;

a second sensor to detect a second amount of erosion in the sealing element, the second amount of erosion being greater than the first amount of erosion; and a third sensor to detect a third amount of erosion in the sealing element, the third amount of erosion being greater than the second amount of erosion.

17. The system of claim 13, where the concentric rings are integrated into the sealing element, each ring comprising a sensor for detecting a different amount of erosion of the sealing element; and where the control system ceases drilling activities if the difference in the rate of rotation of the drill string and the rate of rotation of the sealing element is more than at least one of 1%, 2%, 3%, 4%, 5%, 10%, 15%, 20%, 25%, and 50%.

18. The system of 17, where the rotation sensing system comprises a first rotation sensor for detecting the rate of rotation of the drill string and a second rotation sensor for detecting a rate of rotation of the assembly.

19. The system of claim 13, where the one or more erosion sensors are embedded at different positions within the sealing element relative to an interior surface of the sealing element, an erosion sensor among the one or more erosion sensors being triggered when wear in the sealing element impacts at least part of the erosion sensor.

20. The system of claim 13, where the control system compares the information to one or more predefined thresholds; and where the control system discontinues operation of the drill string automatically when at least some of the information exceeds a predefined threshold among the one or more predefined thresholds.

21. The system of claim 13, where the control system outputs the information for display;

where the control system receives user input following display of the information; and where the control system discontinues operation of the drill string based on the user input.

22. The system of claim 13, where the control system is or comprises a computing system for exchanging signals in real-time.

* * * * *